United States Patent [19]

Iida et al.

[11] Patent Number: 4,872,820

[45] Date of Patent: Oct. 10, 1989

[54] AXIAL FLOW FLUID COMPRESSOR WITH ANGLED BLADE

[75] Inventors: Toshikatsu Iida, Yokohama; Takayoshi Fujiwara, Kawasaki; Yoshinori Sone, Yokohama, all of Japan

[73] Assignee: Kabushiki Kaisha Toshiba, Kawasaki, Japan

[21] Appl. No.: 280,880

[22] Filed: Dec. 7, 1988

[30] Foreign Application Priority Data

Jan. 5, 1988 [JP] Japan ..... 63-493

[51] Int. Cl.[4] ..... F04B 39/00

[52] U.S. Cl. ..... 418/220; 417/356

[58] Field of Search ..... 418/220; 417/354, 356; 415/71, 72, 73

[56] References Cited

U.S. PATENT DOCUMENTS

| | | | |
|---|---|---|---|
| 1,295,068 | 2/1919 | Rolken | 418/220 |
| 2,401,189 | 5/1944 | Quiroz | 418/220 |
| 3,719,436 | 3/1973 | McFarlin | 417/356 |

FOREIGN PATENT DOCUMENTS

| | | |
|---|---|---|
| 691503 | 5/1953 | United Kingdom . |
| 2030227 | 4/1980 | United Kingdom . |
| 2165890 | 4/1986 | United Kingdom . |

*Primary Examiner*—Carlton R. Croyle
*Assistant Examiner*—D. Scheurmann
*Attorney, Agent, or Firm*—Cushman, Darby & Cushman

[57] ABSTRACT

A compressor includes a cylinder, and a rotary rod arranged in the cylinder. A spiral groove is formed on the outer periphery of the rotary rod. The spiral groove is formed such that its depth direction extending from the bottom of the groove to the opening thereof is inclined at a predetermined angle toward a discharge side of the cylinder with respect to the axis of the rotary rod. Pitches of the spiral groove are gradually narrowed with distance from the suction-side end of the cylinder. A spiral blade is fitted in the spiral groove to be slidable in the depth direction. The blade divides a space between the outer periphery of the rotary rod and the inner surface of the cylinder into a plurality of working chambers. When the cylinder and rotary rod are relatively rotated, a fluid, introduced into the suction-side end of the cylinder, is transported toward the discharge-side end of the cylinder through the working chambers.

12 Claims, 5 Drawing Sheets

AXIAL FLOW FLUID COMPRESSOR WITH ANGLED BLADE

BACKGROUND OF THE INVENTION

1. Field of the Invention

The present invention relates to a fluid compressor and, more particularly, to a fluid compressor for compressing a refrigerant gas in a refrigeration cycle, for example.

2. Description of the Related Art

Various conventional compressors such as a reciprocating compressor and a rotary compressor are known to those skilled in the art. In these conventional compressors, a structure of a drive unit such as a crankshaft for transmitting a rotational force to a compression section and a structure of the compression section are complex, and the number of components used in the compressor is large. In addition, in order to improve compression efficiency in a conventional compressor, a check valve must be arranged on its delivery side. However, a pressure difference between the inlet and outlet sides of the check valve is large, and a gas tends to leak from the check valve. Therefore, compression efficiency is degraded. In order to solve this problem, high dimensional precision of the constituting components and high assembly precision must be maintained, thus resulting in high cost.

A screw pump is disclosed in U.S. Pat. No. 2,401,189. In this pump, a columnar rotary member is fitted in a sleeve, and a spiral groove is formed on the surface of the rotary member. A spiral blade is slidably fitted in the spiral groove. Upon rotation of the rotary member, a fluid, sealed between the adjacent turns of the blade in the space between the outer surface of the rotary member and the inner surface of the sleeve, is transported from one end of the sleeve to the other.

The screw pump can transport the fluid but does not have a function for compressing the fluid. In order to seal the transported fluid, the outer surface of the blade must be always in contact with the inner surface of the sleeve. During rotation of the rotary member, however, the blade itself is deformed in the groove, and it cannot easily slide smoothly in the groove. For these reasons, it is difficult to keep the outer surface of the blade in slidable contact with the inner surface of the sleeve, and therefore it is difficult to satisfactorily seal the fluid. As a result, a compression operation cannot be performed by the structure of the screw pump.

SUMMARY OF THE INVENTION

The present invention has been made in consideration of the above situation, and has as its object to provide a fluid compressor which can effectively compress a fluid with a relatively simple structure and can be easily manufactured and assembled.

In order to achieve the above object of the present invention, there is provided a compressor comprising: a cylinder having a suction-side end and a discharge-side end; a columnar rotary member arranged in the cylinder to extend in the axial direction thereof and be eccentric thereto, and rotatable relative to the cylinder while part of the rotary member is in contact with the inner peripheral surface of the cylinder, the rotary member having a spiral groove on the outer periphery thereof, the groove having pitches narrowed gradually with distance from the suction-side end of the cylinder, and the groove being formed such that a depth direction thereof extending from the bottom of the groove to an opening thereof is inclined at a predetermined angle toward the discharge-side end of the cylinder with respect to a direction perpendicular to the axis of the rotary member; a spiral blade fitted in the spiral groove to be slidable in the depth direction, having an outer peripheral surface intimately in contact with the inner peripheral surface of the cylinder, and dividing a space between the inner peripheral surface of the cylinder and the outer periphery of the rotary member into a plurality of working chambers; and driving means for relatively rotating the cylinder and the rotary member, thereby introducing a fluid from the suction-side end of the cylinder into the cylinder, and transporting this fluid toward the discharge-side end of the cylinder through the working chambers.

BRIEF DESCRIPTION OF THE DRAWINGS

FIGS. 1 to 5D show a fluid compressor according to an embodiment of the present invention, in which FIG. 1 is a sectional view showing an overall structure of the compressor, FIG. 2 is a partially cutaway side view of the compression section of the compressor, FIG. 3 is a sectional view taken along line III—III in FIG. 2, FIG. 4 is an enlarged sectional view showing parts of a spiral groove and a spiral blade, and FIGS. 5A to 5D are views showing compression processes of a refrigerant gas;

DETAILED DESCRIPTION OF THE PREFERRED EMBODIMENTS

Preferred embodiments of the present invention will be described in detail with reference to the accompanying drawings.

Figure 1:
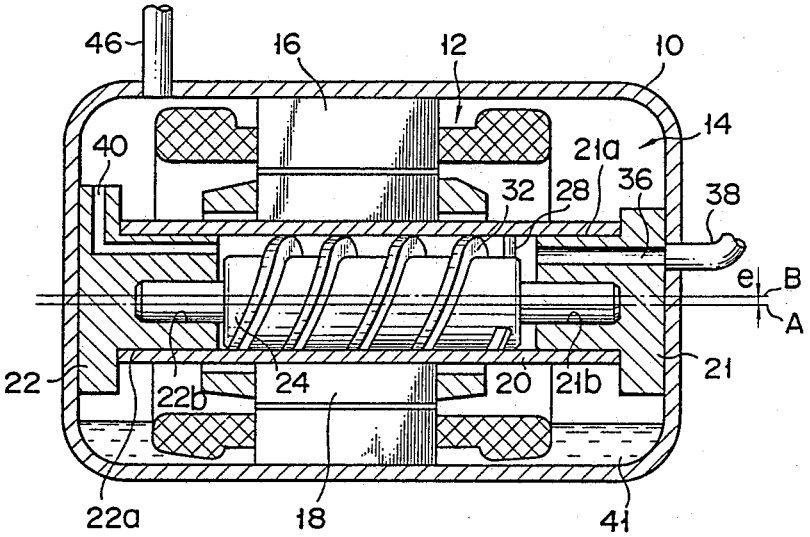

FIG. 1 shows an embodiment in which the present invention is applied to a compressor for compressing a refrigerant gas in a refrigeration cycle.

The compressor comprises closed case 10, electric motor section 12 and compression section 14, latter two of which are arranged in case 10. Motor section 12 includes substantially annular stator 16 fixed on the inner surface of case 10 and annular rotor 18 arranged inside stator 16.

Compression section 14 comprises cylinder 20, and rotor 18 is coaxially fixed to the outer periphery of cylinder 20. Both ends of cylinder 20 are rotatably supported by bearings 21 and 22 fixed to the inner surface of case 10 and are sealed by the bearings, respectively. In particular, the right end, i.e., the suction-side end of cylinder 20 is rotatably fitted on peripheral surface **21*a* of bearing 21. The left end, e.g., the discharge-side end of cylinder 20 is rotatably fitted on peripheral surface 22*a* of bearing 22. Therefore, cylinder 20 and rotor 18** fixed thereto are supported by bearings 21 and 22 so as to be coaxial with stator 16.

Columnar rotary rod 24 having a diameter smaller than that of the inner diameter of cylinder 20 is axially arranged in cylinder 20. Central axis A of rod 24 is eccentric from central axis B of cylinder 20 by distance e. Part of the outer periphery of rod 24 is in contact with the inner peripheral surface of cylinder 20. The right end portion of rod 24 is rotatably inserted in bearing hole **21*b* formed in bearing 21, and the left end portion of rod 24 is rotatably inserted in bearing hole 22*b* formed in bearing 22. Bearing holes 21*a* and 22*b* are coaxial with each other and are eccentric from central axis B of cylinder 20 by distance e. Therefore, rod 24 can be rotatably supported by bearings 21 and 22 at a predetermined position with respect to cylinder 20**.

Figure 2:
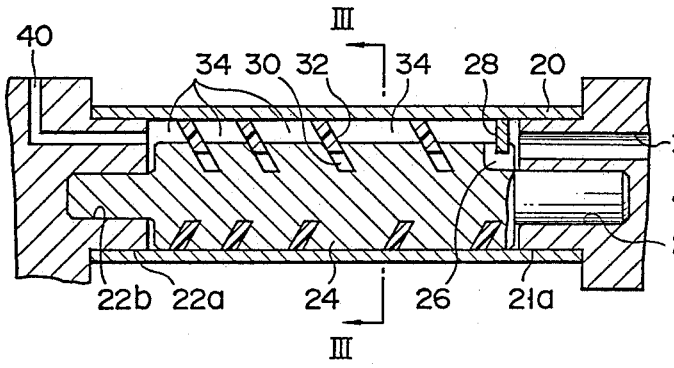

Engaging groove 26 is formed on the outer periphery at the right end portion of rod 24, as is shown in FIGS. 1 and 2. Drive pin 28 projecting from the inner peripheral surface of cylinder 20 is fitted in groove 26 to be movable in the radial direction of the cylinder. When electric motor section 12 is energized to rotate cylinder 20 together with rotor 18, the rotational force of cylinder 20 is transmitted to rod 24 through pin 28. As a result, rod 24 is rotated within cylinder 20 while the outer periphery of rod 24 is partially in contact with the inner surface of cylinder 20.

Figure 4:
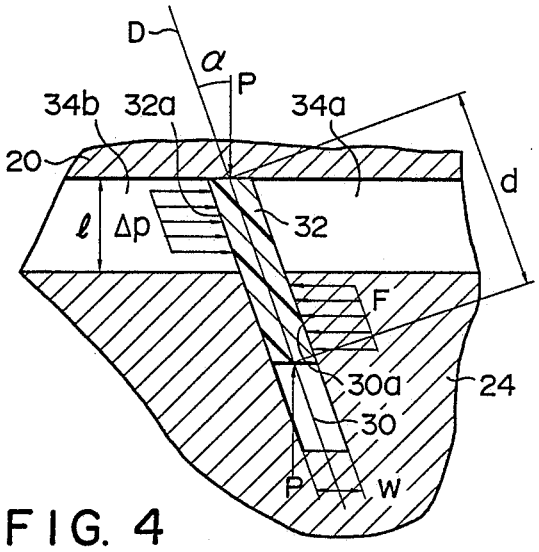

As is shown in FIGS. 1 and 2, spiral groove 30, extending between the two ends of rod 24, is formed on the outer peripheral surface of rod 24. As is best illustrated in FIG. 2, the pitches of turns of groove 30 gradually become narrower with distance from the right end of cylinder 20, i.e., from the suction-side end of the cylinder. As is shown in FIG. 4, groove 30 is formed such that depth direction D thereof, which extends from the bottom of the groove to the opening thereof, is inclined at predetermined angle $\alpha$ toward the discharge-side end of cylinder 20 with respect to a direction perpendicular to the central axis of rotary rod 24. Spiral blade 32 is fitted in groove 30. The thickness of blade 32 is almost equal to the width of groove 30. Blade parts can be reciprocally moved in groove 30 in depth direction D of the groove. Therefore, each part of blade 32 are inclined at angle $\alpha$ to the direction perpendicular to the central axis of rod 24 while the outer periphery of blade 32 is directed toward the discharge-side of cylinder 20. The outer peripheral surface of blade 32 slides on the inner peripheral surface of cylinder 20 intimately in contact therewith. Blade 32 is formed of an elastic material such as Teflon (Trademark), and fitted into groove 32 by utilizing its elasticity.

Figure 3:
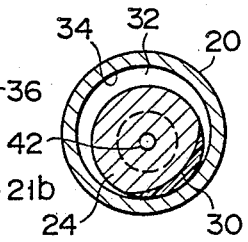

A space between the inner peripheral surface of cylinder 20 and the outer periphery of rod 24 is partitioned into a plurality of working chambers 34 by blade 32. Each working chamber 34 is defined between two adjacent turns of blade 32. As is shown in FIG. 3, working chamber 34 has a substantially crescent-like shape extending along blade 32 from a contact portion between rod 24 and the inner surface of cylinder 20 to the next contact portion. The capacities of working chambers 34 are reduced gradually with distance from the suction-side of cylinder 20.

As is shown in FIGS. 1 and 2, suction hole 36 extending in the axial direction of cylinder 20 is formed in bearing 21. One end of hole 36 is open into the suction-side end of cylinder 20, and the other end thereof is connected to suction tube 38 of the refrigeration cycle. Discharge hole 40 extending along the axial direction of cylinder 20 is formed in bearing 22. One end of hole 40 is open into the discharge-side end of cylinder 20, and the other end thereof is open inside case 10. Lubrication oil 41 is stored in the bottom of case 10.

Reference numeral 46 in FIG. 1 denotes a discharge tube which communicates with the interior of case 10.

The operation of the compressor having the above mentioned arrangement will be described.

When electric motor section 12 is energized, rotor 18 is rotated, so that cylinder 20 is simultaneously rotated. At the same time, rotary rod 24 is rotated while part of its outer periphery is in slidable contact with the inner surface of cylinder 20. These relative rotary motions of rod 24 and cylinder 20 is assured by transmitting means which has pin 28 and engaging groove 26. Blade 32 is rotated integrally with rod 24.

Since blade 32 is rotated while its outer peripheral surface is in slidable contact with the inner surface of cylinder 20, each part of blade 32 is pushed into groove 30 as it comes close to each contact portion between the outer periphery of rod 24 and the inner peripheral surface of cylinder 20, and emerges from the groove as it goes away from the contact portion. When compression section 14 is operated, refrigerant gas is sucked into cylinder 20 through suction tube 38 and suction hole 36. This gas is confined in working chamber 34 located at the suction-side end. As is shown in FIGS. 5A to 5D, upon rotation of rod 24, the gas is sequentially transferred to working chamber 34 at the discharge-side end while the gas is confined between the two adjacent turns of blade 32. Since the capacities of working chambers 34 are reduced gradually with distance from the suction side, the refrigerant gas is gradually compressed during transportation. The compressed refrigerant gas is delivered from discharge hole 40 formed in bearing 22 into case 10. The gas then returns to the refrigeration cycle through discharge tube 46.

As is shown in FIG. 4, during the above compression operation, side pressure $\Delta P$ acts on high-pressure side surface **32*a* of blade 32, i.e., the side surface located on the discharge side of cylinder 20. More specifically, each turn of blade 32 is located between two adjacent working chambers 34*a* and 34*b*. Pressure in working chamber 34*b* is higher than that in working chamber 34*a*. For this reason, the pressure difference between working chambers 34*a* and 34*b* acts as side pressure $\Delta P$ on high-pressure side surface 32*a* of blade 32**.

Figure 6:
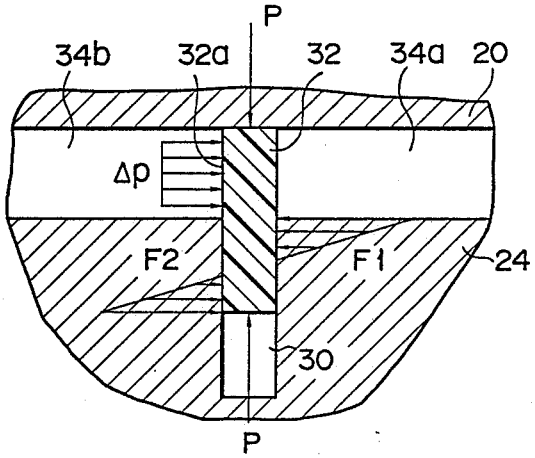
FIG. 6 is a sectional view showing different structures of the spiral groove and the spiral blade and corresponding to FIG. 4.
Figure 5A:
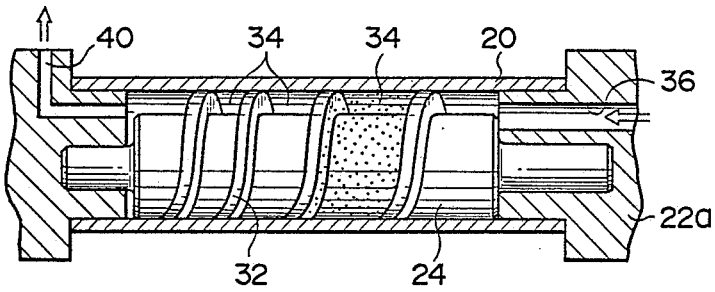
Figure 5B:
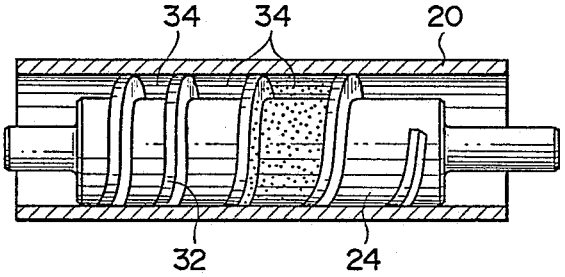
Figure 5C:
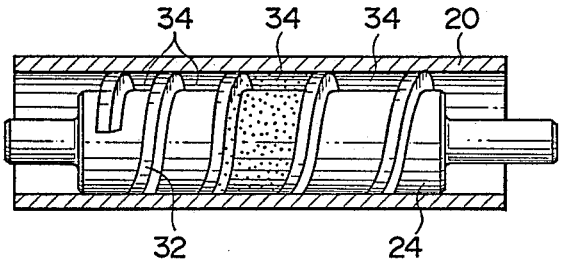
Figure 5D:
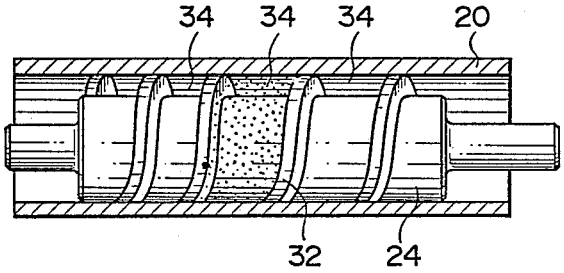

As is shown in FIG. 6, assume that spiral groove 30 is formed such that its depth direction is perpendicular to the central axis of rotary rod 24, and that blade 32 is reciprocated in a direction perpendicular to the central axis of rotary rod 24. In this case, side pressure $\Delta P$ acts on high-pressure side surface **32*a* of blade 32 during compression. A couple of forces are generated on blade 32 due to side pressure $\Delta P$. Since blade 32 is rotated during compression, it receives centrifugal force P and reaction force P corresponding to the centrifugal force from cylinder 20. In addition, since blade 32 extends in a direction perpendicular to the central axis of rotary rod 24, the acting directions of the centrifugal force and reaction force P coincide with the direction of blade extension. Therefore, no couple of forces caused by the centrifugal force and the reaction force act on blade 32, and only the couple of forces caused by side pressure $\Delta P$ act thereon. For this reason, as is shown in FIG. 6, blade 32 receives local side pressures Fl and F2 from rotary rod 24 due to the couple of forces and is locally worn. If such wear occurs in the blade, a gap is formed between blade 32 and groove 30, and the working fluid leaks from this gap, thereby degrading efficiency of the compressor. When compression is performed while blade 32** is kept worn, suction pressure of the fluid must be set high so as to compensate for pressure loss caused by the leakage.

To the contrary, according to this embodiment, groove 30 and blade 32 fitted therein extend at inclination angle $\alpha$ with respect to the direction perpendicular to the central axis of rotary rod 24. For this reason, the couple of forces caused by the centrifugal force and reaction force P act on blade 32. The outer peripheral portion of blade 32 is inclined toward the high-pressure side, i.e., directed toward the discharge side of cylinder 20. Thus, the couple of forces caused by the centrifugal force and reaction force P act to cancel the couple of forces caused by side pressure $\Delta P$. Therefore, no local side pressure acts on blade 32, and uniform side pressure F acts on that side surface of the blade which is opposite to wall surface 30*a* of groove 30.

As a result, local wear of blade 32 can be prevented.

Optimum inclination angle $\alpha$ is an angle for balancing the couple of forces generated by side pressure $\Delta P$ and the couple of forces generated by the centrifugal force and reaction force P. This optimum inclination angle is calculated by the following equation.

That is, since the couple of forces generated by side pressure $\Delta P$ are given as $\Delta P \cdot l^2/2$ and the couple of forces generated by the centrifugal force and reaction force P are given as $d \cdot \sin\alpha \cdot P \cdot w$, $$\Delta P \cdot l^2)/2 = \alpha \cdot \sin\alpha \cdot \Delta Pe \cdot w$$

then $$\sin\alpha = (\Delta P \cdot l^2)/(2 \cdot \Delta Pe \cdot w \cdot d)$$

therefore $$\alpha = \sin^{-1} \cdot \tfrac{1}{2} \cdot \frac{\Delta P}{\Delta Pe} \cdot \frac{l^2}{w \cdot d}$$

where l is the projecting height of blade, d is the height of the blade, and w is the width of the blade.

Even if blade 32 is inclined at an angle other than the optimum inclination angle, side pressure F per unit area, which acts on blade 32 from the rotary rod, can be reduced as compared with the case wherein the blade extends in a direction perpendicular to the central axis of rotary rod 24. Therefore, inclination angle $\alpha$ of blade 32 is not limited to the optimum inclination angle.

With the compressor having the structure described above, pitches of groove 30 formed on rotary rod 24 gradually become narrower with distance from the suction side of cylinder 20. That is, the capacities of working chambers 34 partitioned by blade 32 are reduced gradually toward the discharge side. Therefore, the refrigerant gas can be compressed during transportation from the suction side to the delivery side of cylinder 20. In addition, since the refrigerant gas is transferred and compressed while being confined in working chambers 34, the gas can be efficiently compressed even if no discharge valve is arranged on the discharge side of the compressor.

Since there is no need of a discharge valve, the number of components can be reduced, so that the structure of the compressor can be simplified. Moreover, since rotor 18 of electric motor section 12 is supported by cylinder 20 of compression section 14, an additional rotating shaft and additional bearings for supporting the rotor need not be used. Therefore, the number of components can be further reduced, and the structure of the compressor can be further simplified.

Groove 30 and blade 32 are inclined at predetermined angle $\alpha$ to the direction perpendicular to the central axis of rotary rod 24. For this reason, local wear of blade 32 can be eliminated. Thus, leakage of the working fluid can be prevented, and the working fluid can be efficiently compressed. The service life of blade 32 can also be prolonged.

Cylinder 20 and rotary rod 24 are in contact with each other while they are rotated in the same direction. Therefore, wear between cylinder 20 and rod 24 is small, and these members can be smoothly rotated, thus reducing vibrations and noise.

The transportation capacity of the compressor depends on the initial pitch of blade 32, i.e., the capacity of working chamber 34 at the suction-side end of cylinder 20. According to this embodiment, the pitches of blade 32 gradually become narrower with distance from the suction-side end of cylinder 20. If the number of turns of blade 32 is fixed, the first pitch of the blade and hence, the transportation capacity of the compressor, according to this embodiment, can be made greater than those of a compressor whose blade has regular pitches throughout the length of its rotary rod. In other words, a highly efficient compressor can be realized.

Figure 7:
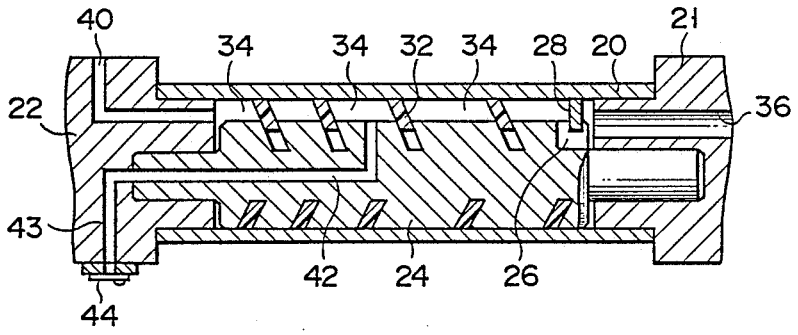
FIG. 7 is a sectional view showing a modification of the compression section and corresponding to FIG. 2.

In the first embodiment, as is shown in FIG. 7, pressure reducing path 42 may be formed in rotary rod 24. One end of path 42 is open to the intermediate working chamber between the suction and the discharge-side ends of cylinder 20, and the other end of path 42 communicates with case 10 through discharge path 43 formed in bearing 22. The outlet of path 43 is closed by check valve 44 which is opened when pressure in paths 42 and 43 reaches a predetermined value, i.e., when pressure in working chamber 34 which communicates with path 42 reaches the predetermined value.

With the above arrangement, even if suction pressure of the compressor is very high, e.g., immediately after starting the compressor, the fluid can be released into case 10 through pressure reducing path 42, discharge path 43, and check valve 44 before the fluid is compressed in working chambers 34 to an abnormally high pressure.

Figure 8:
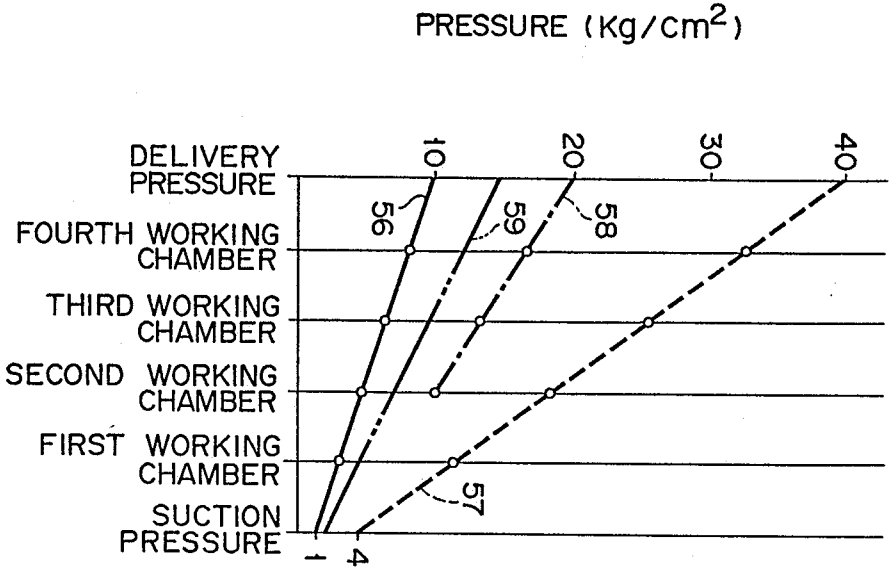
FIG. 8 is a view showing a compressed state of the working fluid when the compression section shown in FIG. 7 is used.

FIG. 8 shows compression characteristics of the compressor having the above construction. For example, assume that a compressor is arranged to exhibit compression characteristics in the normal operation state, as is indicated by line 56. If the suction pressure is higher than a preset value, the delivery pressure of the compressor becomes an abnormally high value, as is indicated by line 57. However, if check valve 44 is designed to be opened at pressure of, e.g., 20 kg/cm$^2$ (absolute pressure) or are, pressure of the working fluid rises as is shown by line 58. Therefore, the pressure can be prevented from rising to a abnormally high value, unlike a structure without pressure reducing path 42, exhaust path 43, and check valve 44. Moreover, it is possible to obtain pressure characteristics indicated by line 59 upon adjustment of an opening pressure of check valve 44. In the compressor having the construction described above, damage to the compressor caused by an abnormally high pressure can be satisfactorily prevented, and reliability of the compressor can be improved.

Figure 9:
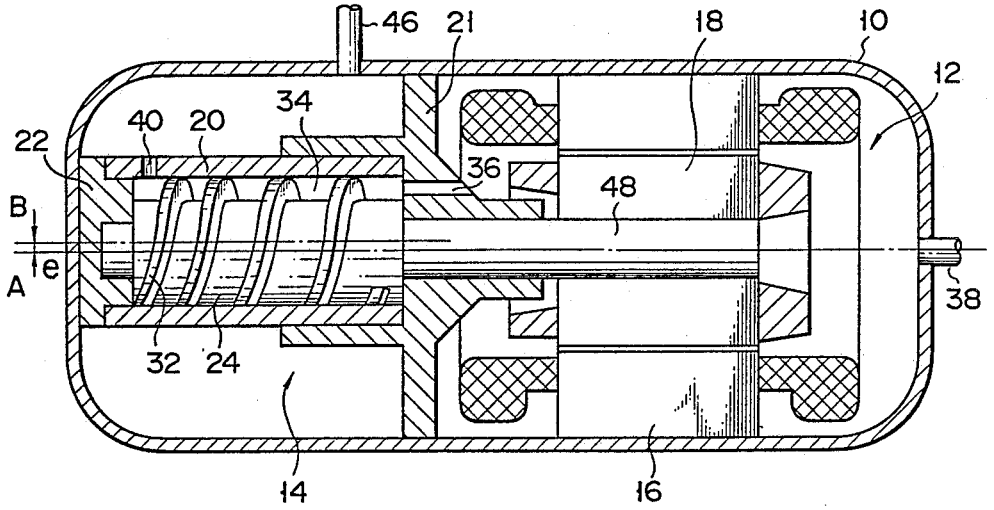
FIG. 9 is a sectional view of a fluid compressor according to another embodiment of the present invention.

FIG. 9 shows a fluid compressor according to a second embodiment of the present invention.

In this embodiment, electric motor section 12 and compression section 14 are arranged horizontally in case 10. Bearing 21 is arranged at the central portion of case 10 so that the interior of case 10 is airtightly partitioned into two compartments for sections 12 and 14 by bearing 21. Horizontal rotating shaft 48 is rotatably supported by bearing 21. Rotor 18 of motor section 18 is coaxially fixed to the right end portion of shaft 48 and located inside stator 16.

One end of rotary rod 24 is coaxially fixed to the left end of rotating shaft 48. The left end of rod 24 is rotatably supported by bearing 22 fixed to the inner surface of case 10. In the same manner as in the first embodiment, rod 24 is formed with, on its outer periphery, a spiral groove having pitches gradually become narrower with distance from the right end of the rod. Spiral blade 32 is fitted in this groove. The groove and blade 32 are inclined at predetermined angle $\alpha$ toward the left end of rod, i.e., the discharge side, with respect to a direction perpendicular to the axis of rotary rod 24. Outside rod 24, cylinder 20 extends in parallel to the rod. Both ends of the cylinder are rotatably supported by bearings 21 and 22, respectively. Central axis B of cylinder 20 is eccentric from central axis A of rod 24 by distance.

Suction hole 36 is formed in bearing 21 and open into the right end of cylinder 20, i.e., the suction-side end. The other end of suction hole 36 communicates with suction tube 38 through the chamber which stores electric motor section 12 in case 10. In this embodiment, discharge hole 40 is formed in the discharge-side end portion of cylinder 20 and the interior of the cylinder communicates with discharge tube 46 through discharge hole 40 and the interior of case 10.

With the second embodiment having the construction described above, the compressor can efficiently compress gas and local wear of the blade can be prevented as in the first embodiment.

The present invention is not limited to the particular embodiments described above. Various changes and modifications may be made within the spirit and scope of the invention. For example, the compressor of the present invention is not limited to applications in the refrigeration cycle but can be extended to other equipment. In addition, the compressor is not limited to the type in which the electric motor section and the compression section are arranged in the closed case, but can be applied to an open type compressor in which pipes are directly coupled to a suction hole and a discharge hole, respectively.

What is claimed is:

1. A compressor comprising:

a cylinder having a suction-side end and a discharge-side end;

a columnar rotary member arranged in the cylinder to extend in the axial direction thereof and be eccentric thereto, and rotatable relative to the cylinder while part of the rotary member is in contact with the inner peripheral surface of the cylinder, said rotary member having a spiral groove on the outer periphery thereof, said groove having pitches narrowed gradually with distance from the suction-side end of the cylinder, and said groove being formed such that a depth direction thereof extending from the bottom of the groove to an opening thereof is inclined at a predetermined angle toward the discharge-side end of the cylinder with respect to a direction perpendicular to the axis of the rotary member;

a spiral blade fitted in the spiral groove to be slidable in the depth direction, having an outer peripheral surface intimately in contact with the inner peripheral surface of the cylinder, and dividing a space between the inner peripheral surface of the cylinder and the outer periphery of the rotary member into a plurality of working chambers; and driving means for relatively rotating the cylinder and the rotary member, thereby introducing a fluid from the suction-side end of the cylinder into the cylinder, and transporting this fluid toward the discharge-side end of the cylinder through the plurality of working chambers.

2. A compressor according to claim 1, wherein the inclination angle of said blade is determined so as to balance a couple of forces generated by a difference between pressures in two adjacent working chambers and acting on the blade with a couple of forces generated by a centrifugal force acting on the blade upon relative rotation between the rotary member and the cylinder.

3. A compressor according to claim 1., wherein said driving means includes an electric motor section for rotating the cylinder and transmitting means for transmitting the rotational force of the cylinder to the rotary member so as to rotate the rotary member interlockingly with the cylinder.

4. A compressor according to claim 3, wherein said electric motor section has a rotor fixed to the outer periphery of the cylinder and a stator located outside the rotor.

5. A compressor according to claim 3, wherein said transmitting means includes an engaging groove formed in the outer periphery of the rotary member, and a projecting portion extending from the inner peripheral surface of the cylinder and fitted in the engaging groove to be movable in the radial direction of the cylinder.

6. A compressor according to claim 1, wherein said driving means includes a rotating shaft coaxially fixed to the rotary member, and an electric motor section for rotating the rotating shaft.

7. A compressor according to claim 1, which further comprises a first bearing for rotatably supporting the suction-side end of the cylinder, and a second bearing for rotatably supporting the discharge-side end of the cylinder, and wherein said rotary member has a pair of end portions rotatably supported by the first and second bearings, respectively.

8. A compressor according to claim 7, which further comprises a closed case for storing the cylinder, first and second bearings, and driving means; a suction hole having one end communicating with the interior of the suction-side end of the cylinder and the other end communicating with the outside of the closed case; and a discharge hole having one end communicating with the interior of the discharge-side end of the cylinder and the other end communicating with the interior of the closed case.

9. A compressor according to claim 8, wherein said discharge hole is formed in the second bearing.

10. A compressor according to claim 8, wherein said discharge hole is formed in the cylinder.

11. A compressor according to claim 7, which further comprises pressure reducing means for releasing the fluid in the working chambers when pressure of the fluid in the working chambers is higher than a predetermined value.

12. A compressor according to claim 11, wherein said pressure reducing means comprises a pressure reducing path which is formed in the rotary member and communicates with one of the working chambers, a discharge path formed in the first or second bearing and having one end which communicates with the pressure reducing path and the other end open to the outside, and a valve arranged to close the other end of the discharge path and opened when pressure of the fluid in said one working chamber reaches the predetermined value.

* * * * *